US005307124A

United States Patent [19]

Stelter

[11] Patent Number: 5,307,124

[45] Date of Patent: Apr. 26, 1994

[54] DEVELOPMENT METHOD AND APPARATUS INCLUDING TONER PRE-CHARGING CAPABILITY

[75] Inventor: Eric C. Stelter, Rochester, N.Y.

[73] Assignee: Eastman Kodak Company, Rochester, N.Y.

[21] Appl. No.: 979,676

[22] Filed: Nov. 20, 1992

[51] Int. Cl.[5] ..... G03G 15/00

[52] U.S. Cl. ..... 355/246; 118/651; 118/689; 355/260

[58] Field of Search ..... 355/260, 246, 208, 245, 355/251, 253; 222/DIG. 1; 118/651, 656, 688-691, 657, 658, 653, 689; 430/120

[56] References Cited

U.S. PATENT DOCUMENTS

| | | | |
|---|---|---|---|
| 4,230,070 | 10/1980 | Murasaki et al. | 118/658 |
| 4,382,420 | 5/1983 | Ohnuma et al. | 118/651 |
| 4,437,299 | 8/1982 | Ozawa et al. | 430/122 |
| 4,572,102 | 2/1986 | Yuge et al. | 118/689 |
| 4,615,606 | 10/1986 | Nishikawa | 355/3 DD |
| 4,924,270 | 5/1990 | Sako et al. | 355/246 |
| 5,034,775 | 7/1991 | Folkins | 355/259 |
| 5,079,590 | 1/1992 | DeCecca | 355/260 |
| 5,095,339 | 3/1992 | Terashima | 355/251 |

FOREIGN PATENT DOCUMENTS

0482867A2 10/1991 European Pat. Off. .... G03G 15/08

*Primary Examiner*—A. T. Grimley
*Assistant Examiner*—T. A. Dang
*Attorney, Agent, or Firm*—Tallam I. Nguti

[57] ABSTRACT

A reproduction apparatus is provided including a development apparatus having a capability for precharging replenishment toner particles being added to a triboelectric charging sump containing partially depleted two-component developer material. The precharging capability of the development apparatus is provided by an AC bias and a first DC bias connected to a first toner particle metering member. A second DC bias is connected to a second metering member. The precharging capability of the present invention is particularly useful during development of images requiring large amounts of toner particles.

14 Claims, 3 Drawing Sheets

DEVELOPMENT METHOD AND APPARATUS INCLUDING TONER PRE-CHARGING CAPABILITY

BACKGROUND OF THE INVENTION

1. Technical Field

The present invention relates to the development of latent images using charged toner particles, and more particularly to a development method and apparatus involving a toner pre-charging capability.

2. Background Art

In electrostatographic copiers and printers that produce or reproduce copies of images, it is well known to use charged toner particles, from a quantity of such particles held at a development station, to develop latent electrostatic images on an image-bearing member. As is also well known, the quantity of such toner particles being held at each development station can be contained at a desired concentration in a multiple-component developer material. As images are developed by using up such toner particles, their quantity so held at the development station is gradually depleted through such use, and therefore must be replenished periodically in order to maintain their desired concentration.

Typically, as disclosed for example in U.S. Pat. No. 5,079,590, issued Jan. 7, 1992 to DeCecca; U.S. Pat. No. 4,615,606, issued Oct. 7, 1986 to Nishikawa; and U.S. Pat. No. 4,924,270, issued May 8, 1990 to Sako et al, replenishment of toner particles as such is carried out from a supply of fresh uncharged toner particles held in a supply hopper. The particles are fed from the supply hopper to the development station where they are then charged before being used for image development. Typically, the charging of the toner particles in the development station is accomplished by rubbing them with oppositely-charging carrier particles either directly on the surface of a transport roller which transports them to an image development area, or alternatively in a sump portion of the development station. In the sump portion, they can be moved, mixed and triboelectrically charged along with oppositely-charging carrier particles for a necessary interval of time in order to achieve a desired charge level on the toner particles before they are transported to an image development area.

Unfortunately, however, the quantity of charged toner particles required from one time to another for image development can vary significantly depending on the density and extent of toner particle laydown of images being developed. As such, the rate at which fresh uncharged toner particles, as above, are replenished or added to the development station therefore also varies. Therefore, when images which require large amounts of charged toner particles are being developed, large amounts of fresh uncharged toner particles must be added to the development station.

In modern high speed reproduction apparatus which include such a development station, there is an increased risk that poorly charged toner particles will be transported to the image development area of the station due to a lack of sufficient time at the high reproduction speed to necessarily move, mix and triboelectrically charge the freshly added uncharged toner particles, along with the depleted developer material in the development station, to the desired level. Such a risk can result in development defects such as wide lines and background contamination. Additionally, such a risk can result in undesirable toner particle dusting out of the development station, and hence contamination elsewhere within a host reproduction apparatus.

SUMMARY OF THE INVENTION

It is, therefore, an object of the present invention to provide a development apparatus that overcomes the disadvantages above.

In accordance with the present invention, a development apparatus for developing latent images in a reproduction apparatus includes a housing that has a sump portion for holding a multiple-component developer material containing carrier particles and toner particles at a desired concentration level. The development apparatus also includes a triboelectric charging device located within the sump portion for moving, mixing and triboelectrically charging the carrier and toner particles in the sump, for a necessary time interval, in order to achieve a desired charge level. A development roller transports the triboelectrically charged developer material into an image developing relationship with latent images to be developed using the charged toner particles.

The development apparatus further includes a replenishment assembly for supplying fresh, uncharged toner particles to the sump portion of the development apparatus for triboelectric charging. The replenishment assembly includes a hopper portion for holding a supply of fresh, uncharged toner particles, metering members for metering quantities of such toner particles from the hopper portion into the sump portion, and electrical pre-charging means for electrically pre-charging the quantity of toner particles being metered, thereby preventing poorly charged toner particles from being transported into the image development relationship, and thereby reducing the interval of time necessary for triboelectrically charging a metered quantity of toner particles in the sump portion to the desired charge level.

BRIEF DESCRIPTION OF THE INVENTION

In the detailed description of the invention presented below, reference is made to the drawings, in which:

FIG. 1 is a schematic illustration of an exemplary reproduction apparatus including the development apparatus of the present invention;

FIG. 2 is an end view, partly in section, of the development apparatus of the present invention showing the triboelectric charging device and a first embodiment of the toner pre-charging means thereof; and FIG. 3 is an end view, partly in section, of the development apparatus of the present invention showing the triboelectric charging device and a second embodiment of the toner pre-charging means thereof.

DETAILED DESCRIPTION OF THE INVENTION

Because electrostatographic reproduction machines are well known, the present description will be directed in particular to elements thereof which form part of or cooperate more directly with the present invention. Elements thereof not specifically shown or described herein are assumed selectable from those known in the prior art.

Figure 1:
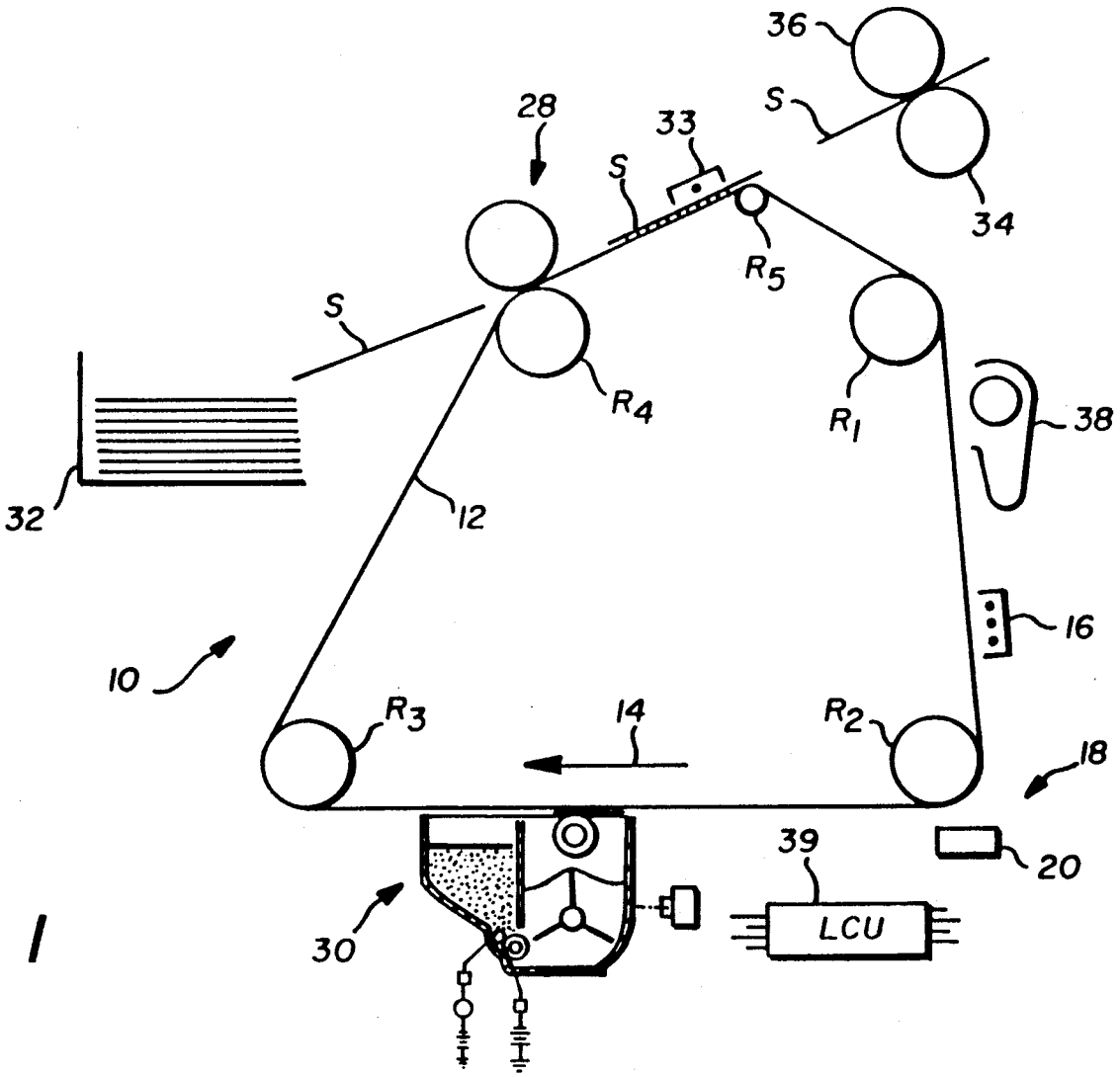

Referring to FIG. 1, an electrostatographic reproduction apparatus 10 such as a copier or printer has a dielectric image forming and image transfer member such as a flexible photo-conductive web 12. As shown, the flexible web 12 is trained over a series of rotatable rollers including the rollers $R_1$, $R_2$, $R_3$, $R_4$ and $R_5$, and is moved by suitable drive means (not shown) in a clockwise direction as represented by an arrow 14.

A charging station 16 applies an electrostatic charge to the surface of the photo-conductive web 12. At an exposure station 18, projected light, from a write head 20 for example, imagewise dissipates electrostatic charge on portions of the surface of the web 12 in order to form a latent electrostatic image corresponding to the image of an original to be copied or printed. Write head 20 preferably has an array of light-emitting diodes (LEDs) for exposing the photoconductive belt, but it is to be understood that other technologies for imagewise exposure, for example optical technologies, are equally applicable.

The latent electrostatic image on the surface of the web 12 is developed with toners at the development apparatus of the present invention shown generally as 30 (to be described in detail below) in order to form a toner image. As the toner image on web 12 approaches a transfer station 28, an image receiver sheet S is fed from a supply 32 of such sheets for receiving such image. After transfer of the toner image to the receiver sheet, the receiver sheet S is separated or stripped from the web 12 with the aid of the roller $R_5$ acting as a detack roller. A detack charger 33 assists such separation by reducing the level of charges tending to hold the copy sheet S to the surface of the web 12. Following separation from the surface of the web 12, the copy sheet S is passed through a pair of heated fuser rollers 34 and 36 for fusing and fixing the toner image to such receiver sheet S.

Mechanical and electrical cleaning of belt 12 is effected at a cleaning station 38 in preparation for the formation and transfer of another toner image. As is well known in the art, the operation and sequencing of the stations and components of the reproduction apparatus 10 are controlled by a logic and control unit (LCU) shown as 39.

Figure 2:
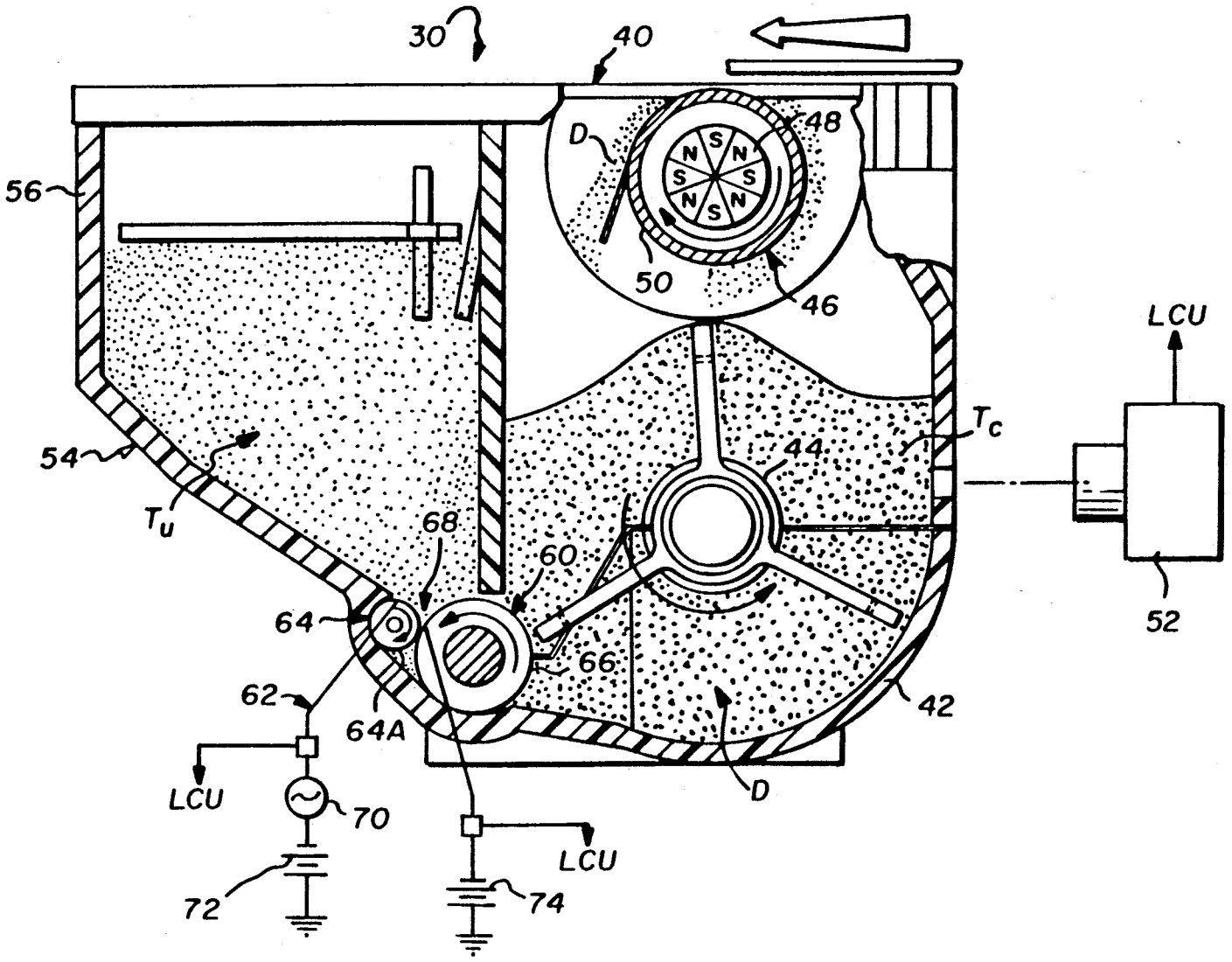
Figure 3:
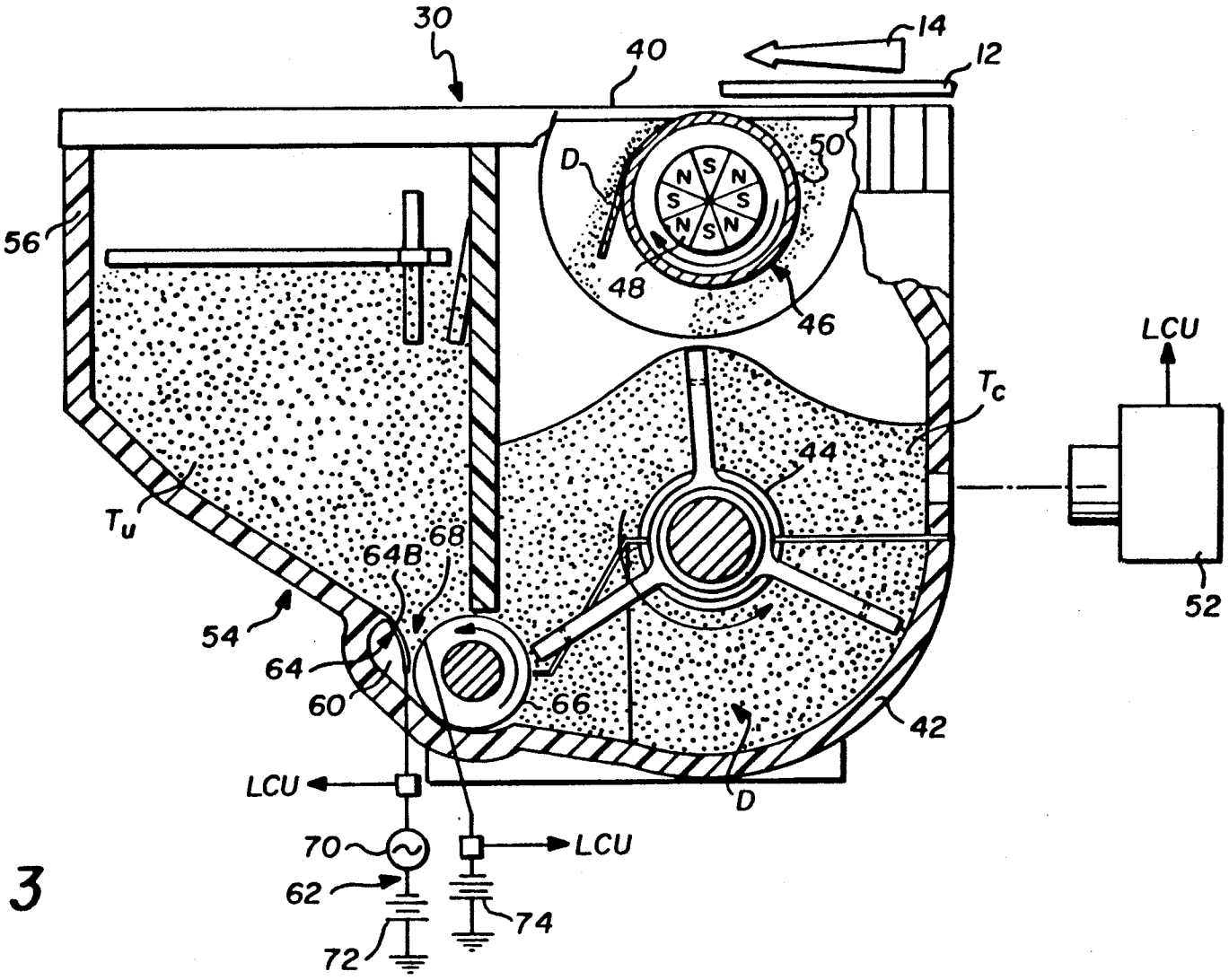

Referring now to FIGS. 2 and 3, the development apparatus 30 of the present invention includes a housing 40 with a sump portion 42 for holding a multiple-component developer material D that contains charged carrier particles, and oppositely charged toner particles $T_c$ at a desired toner particle concentration level. A rotatable, primary developer material charging device 44 is located within the sump portion 42 for moving, mixing and thereby triboelectrically charging the toner particles $T_c$ with the carrier particles of the developer material D in the sump portion 42. As is well known, such moving and mixing of the developer material D must be continued for a characteristically necessary time interval, (a time to depend on the charging characteristics of the components of the developer material), in order to triboelectrically charge the toner particles $T_c$ to a desired charge level that is suitable for high quality image development.

The development apparatus 30 also includes a development roller 46 for transporting the triboelectrically charged developer material D including the toner particles $T_c$ from the sump portion 42 into an image development area and relationship, with electrostatic latent images on the surface of the image bearing member 12. In the image development area the charged toner particles $T_c$ are attracted from the developer material admixture D on the roller 46 onto the surface of the member 12 thereby developing the latent images on the member 12. Following such development, the developer material on the surface of the roller 46 is partially depleted of toner particles, and is returned to the sump portion 42 for re-mixing and re-charging. As shown, the development roller 46 may for example include a rotatable magnetic core 48 of circumferentially arranged and alternating pole magnets, and a non-magnetic shell 50 which supports the developer material admixture D as it is being transported into the image development area.

Image development using attracted toner particles as above ordinarily depletes toner particles contained in the developer material that is repeatedly being returned from the image development area to the sump portion 42. As a result, the quantity and concentration of toner particles left in the developer material D in the development apparatus eventually will drop to an undesirable level, at and below which, the quality of image development is unacceptable. In order to avoid such an undesirable drop in toner concentration, the concentration of toner particles in the development apparatus is monitored.

For monitoring the concentration of toner particles in the developer material D, the development apparatus 30 includes a toner monitor 52, such as that disclosed, for example, in commonly assigned U.S. Pat. No. 4,956,668, issued Sep. 11, 1990 to Arnold et al. Typically, the toner monitor 52 is connected and controlled commonly with a toner particle replenishment assembly, such as the toner particle replenishment assembly of the present invention shown generally as 54. Such control is carried out through the logic and control unit 39 (FIG. 1) for example in order to timely add uncharged toner particles $T_u$ to the sump portion 42 so as to maintain the desired toner concentration of the developer material D. Such addition of uncharged toner particles $T_u$, however, immediately results in a lowering of the average charge level of toner particles $(T_u+T_c)$ in the sump 42. The newly added toner particles $T_u$ must therefore be moved and mixed for a necessary characteristic time interval in order to raise the charge level on them to the desired charge level.

In high speed reproduction apparatus, there is a likely risk when developing high density images or images which require the use of large amounts of toner particles, that a similarly large quantity of uncharged toner particles $T_u$ added in replenishment will result undesirably in image development defects as well as in background contamination and dusting.

To prevent these undesirable results, the replenishment assembly 54 of the present invention includes a hopper portion 56 for holding a supply of fresh or new uncharged toner particles $T_u$, a metering means 60 for metering the toner particles $T_u$ from the hopper portion 56 through to the sump portion 42 for triboelectric charging. More importantly, the replenishment assembly 54 includes electrical charging means 62 for controllably and electrically precharging the new, uncharged toner particles $T_u$ which are being metered into the sump portion 42. Such electrical pre-charging of the toner particles $T_u$ can be controllably achieved to a desired precharge level such as would substantially prevent uncharged or poorly charged toner particles $(T_u+T_c)$ from being transported from the sump portion, during high speed, high density image development periods, to the image development area. Such electrical precharging of the uncharged toner particles $T_u$ also reduces the time interval necessary (in the sump portion 42) for moving and mixing the toner particles $(T_u+T_c)$ in the replenished developer material in order to raise the level of charge on all toner particles in such developer material to the desired level.

In order to enhance the triboelectric charging characteristics of the fresh uncharged toner particles $T_u$ being metered and electrically precharged, oppositely-charging particles may be added to the hopper 56, thereby forming a toner admixture. Such oppositely-charging particles, for example, can be silica beads or polymethacrylate beads.

Referring to FIG. 2, a first embodiment of the metering means 60 is shown and includes an electrically conductive first member 64 in the form of a rotatable roller 64A, and a conductive second member that is a rotatable roller 66 and that forms a toner particle flow nip 68 with the first member 64. Alternatively, a second embodiment of the metering means 60 is shown in FIG. 3 in which the conductive first member 64 is in the form of a flexible cantilevered blade member 64B which also forms a toner particle flow nip 68 with the roller 66.

As further shown in FIGS. 2 and 3, the electrically pre-charging means 62 of the present invention can include an AC bias or voltage from a source 70, and a first DC bias or voltage from a source 72 that is super positioned on the AC voltage. For electrically pre-charging toner particles $T_u$ to a negative polarity, for example, the AC voltage can be about 2 KV peak-peak with a frequency of about 1 kHz, and the first DC voltage can be about −800 V. As shown, the precharging means 62 is connected to ground and to the first member 64 (that is to the roller 64A or blade member 64B).

A second DC bias or voltage from a source 74 is connected to ground and to the rotatable roller 66. Preferably, this second DC bias from the source 74 should have a value different from that of the first DC bias from source 72 in order to create a DC electric field between the rotatable roller 66 and the first member 64A, 64B. The created electric field will tend to cause charged toner particles to move appropriately from one member 64A, 64B for example, to the other 66 or vice versa depending on the direction of the field. For creating such a field for negative toner particles on the pre-charging member 64A, 64B at −800 V DC to flow to second member 66, the second DC bias for example can have a value of about −500 V. Care should be taken to ensure that this value of about −500 V is relatively more negative than a biasing value (not shown) for the sump portion 42 in order to enable particle flow into the sump.

Additionally, the conductivity of the nip-forming members 64A, 64B and 66 should be controlled so that large currents are not caused to pass directly from one member on one side of the nip 68 to the other member across the nip. As such, the rotatable rollers 64A and 66 can be made from doped urethane with conductivities on the order of $10^8$ ohm-cm. A doped urethane roller with a non-conductive coating can also be used in contact with a conductive member such as the blade member 64B.

In the present invention, the rate of uncharged toner particle replenishment is controllably variable, and so are the value set points for the bias sources 70, 72 and 74. With the control means therefor (not labeled) connected in common with the toner monitor 52 to the logic and control unit 39, the rate of toner replenishment as well as the level of electrical pre-charging can be selectively varied for example as a function of humidity to control image quality so as to accomplish the objects of the present invention.

Although the electrical precharging means 62 is shown connected to the first member 64A, 64B and the second DC bias 74 connected to the second member 66, it is understood that such connections can be reversed without affecting the intent and effectiveness of the present invention.

The invention has been described in detail with particular reference to a presently preferred embodiment, but it will be understood that variations and modifications can be effected within the spirit and scope of the invention.

What is claimed is:

1. A development apparatus for developing latent images using toner particles contained in a multiple-component developer material of toner particles and carrier particles, the development apparatus comprising:

(a) a housing including a sump portion for holding the developer material containing toner particles at a desired concentration level;

(b) triboelectric charging means located within said sump portion for moving, mixing and triboelectrically charging the toner particles and carrier particles in said sump portion for a necessary time interval and to a desired charge level;

(c) a development roller for transporting the triboelectrically charged developer material particles from said sump portion into an image development relationship with latent images to be developed using the charged toner particles; and (d) a replenishment assembly for selectively supplying fresh toner particles to said sump portion to replace charged toner particles used up from said transported developer material in image development, said replenishment assembly having a hopper portion for holding a supply of said uncharged fresh toner particles, metering means for metering a quantity of said toner particles from said hopper portion into said sump portion, and electrical pre-charging means for electrically pre-charging said metered toner particles to a pre-charge level, thereby preventing poorly charged toner particles from being transported into image development relationship in the development apparatus, and thereby reducing the time necessary for moving, mixing and triboelectrically charging the metered toner particles and carrier particles in said sump portion to said desired charge level.

2. The development apparatus of claim 1 including a toner concentration monitor and controls for triggering the supply of said fresh toner particles from said hopper portion of said replenishment assembly into said sump portion.

3. The development apparatus of claim 1 wherein said metering means includes a conductive first member and a conductive rotatable roller forming a toner particle flow nip with said first member.

4. The development apparatus of claim 3 wherein said electrical pre-charging means includes means for applying an AC bias and a first DC bias superposed on said AC bias across said toner.

5. The development apparatus of claim 4 wherein said electrical pre-charging means is connected to ground and to said first member for application across said nip to charge toner particles coming into contact with said first member.

6. The development apparatus of claim 5 including a second DC bias connected to said rotatable roller, said second DC bias being different from said first DC bias so as to create a DC electric field between said first member and said rotatable roller for moving pre-charged toner particles therebetween.

7. The development apparatus of claim 6 wherein said fresh toner particles are to be charged negatively and said first DC bias and said second DC bias are −800 V and −500 V, respectively.

8. The development apparatus of claim 6 wherein said Ac bias is approximately 2 KVAC peak-to-peak a frequency of about 1 kHz.

9. The development apparatus of claim 6 wherein toner replenishment rates and values for said AC and DC biases are variable.

10. The development apparatus of claim 6 wherein said first member is also a rotatable roller.

11. The development apparatus of claim 6 wherein said first member is a cantilevered blade member.

12. The development apparatus of claim 9 including logic and control means for selectively varying said AC and first DC biases responsively to maintain image quality.

13. A method for developing latent images requiring various amounts of toner particle laydown, the method comprising the steps of:

(a) moving, mixing and triboelectrically charging a multiple-component developer material containing toner particles and magnetic carrier particles for a necessary time interval in a sump portion of a development apparatus to a desired charge level;

(b) transporting said triboelectrically charged developer material into image development relationship with latent images to be developed using said charged toner particles, thereby resulting in a lower concentration of toner particles in said developer material;

(c) feeding fresh uncharged toner particles from a supply thereof into said sump portion of the development apparatus for moving, mixing and triboelectrically charging therein; and (d) electrically pre-charging said uncharged toner particles during the step of feeding the same into said sump portion of the development apparatus, thereby preventing poorly charged toner particles from being transported into the image development relationship, and thereby reducing the interval of time necessary to triboelectrically charge said fed toner particles to said desired charge level.

14. The development apparatus of claim 4 wherein said electrical precharging means is connected to said roller and a second DC bias is connected to said first member which second DC bias is different from said first DC bias to create a DC electric field between the first member and the roller.

* * * * *

UNITED STATES PATENT AND TRADEMARK OFFICE

CERTIFICATE OF CORRECTION

PATENT NO. : 5,307,124

DATED : April 26, 1994

INVENTOR(S) : Eric C. Stelter

It is certified that error appears in the above-indentified patent and that said Letters Patent is hereby corrected as shown below:

Column 7, line 10, after "peak-to-peak" insert --with --.

Signed and Sealed this

Sixteenth Day of August, 1994

*Attest:*

Bruce Lehman

BRUCE LEHMAN

*Attesting Officer*

*Commissioner of Patents and Trademarks*